US005505448A

United States Patent [19]

Park

[11] Patent Number: 5,505,448

[45] Date of Patent: Apr. 9, 1996

[54] GOLF CLUBHEAD

[75] Inventor: Bill Park, Houston, Tex.

[73] Assignee: BPA Fabrication, Inc., Houston, Tex.

[21] Appl. No.: 346,373

[22] Filed: Nov. 29, 1994

[51] Int. Cl.[6] ..... A63B 53/04

[52] U.S. Cl. ..... 273/167 E; 273/167 H; 273/167 A

[58] Field of Search ..... 273/167 R, 167 A, 273/167 D, 167 E, 167 F, 169, 175, 174, 186.2, 193 R, 194 R, 194 A, 187.4, 164.1; D21/214, 215, 216, 217

[56] References Cited

U.S. PATENT DOCUMENTS

| | | | |
|---|---|---|---|
| D. 93,862 | 11/1934 | Barnhart | 273/167 D |
| D. 185,717 | 7/1959 | Newton | 273/167 D |
| D. 192,515 | 4/1962 | Henrich | 273/167 E |
| D. 257,873 | 1/1981 | MacDougall | 273/167 E |
| 1,690,388 | 11/1928 | Waldron | 273/167 E |
| 3,468,544 | 9/1969 | Antonious | 273/173 |
| 3,829,102 | 8/1974 | Harrison | 273/186.2 |
| 4,065,133 | 12/1977 | Gordos | 273/167 E |
| 5,042,806 | 8/1991 | Helmstetter | 273/167 H |
| 5,203,565 | 4/1993 | Murray | 273/167 E |
| 5,221,086 | 6/1993 | Antonious | 273/167 E |
| 5,318,297 | 6/1994 | Davis | 273/167 E |

OTHER PUBLICATIONS

"Golf Digest", Magazine, Dec. 1981, pp. 57–59.

Titleist® Advertisement for Pro Trajectory® Metals, entitled "Get It All", 1 page, Dec. 1992, Golf Digest.

Anvil® Aluminium Bronze Technology Safari Golf Advertisement entitled "Welcome To The Age of Aluminium Bronze", 8 pages, Dec. 1992, Golf Digest.

Cleveland® Vas® Advertisement, 4 pages, Dec. 1992, Golf Digest.

Head® Advertisement, 1 page, Dec. 1992, Golf Digest.

Taylor Made® Advertisement, entitled "Does Taylor Made Believe in Oversize Drivers?", 2 pages, Dec. 1992, Golf Digest.

L. Dennis, "The Weighting Game", pp. 90–94, 96, Dec. 1992, Golf Digest.

L. Dennis, "Is A Longer, Bigger Driver Worth The Risk?", pp. 101–102, 104, 106, Dec. 1992, Golf Digest.

G. Yocom, "New On The Tee", pp. 108–111, Dec. 1992, Golf Digest.

*Primary Examiner*—Sebastiano Passaniti

*Attorney, Agent, or Firm*—Jennifer S. Sickler; Robert A. McFall; Jenkens & Gilchrist

[57] ABSTRACT

A new golf clubhead has been developed which has a vane extending outwardly from its crown and rear surfaces and extending from the face to the sole of the clubhead. The vane tends to align the clubhead in the direction of motion as it is swung through an arc towards impact with a ball. The clubhead also has a plurality of aerodynamically contoured surfaces that reduce wind resistance to movement of the clubhead through the air.

22 Claims, 3 Drawing Sheets

Fig. 4
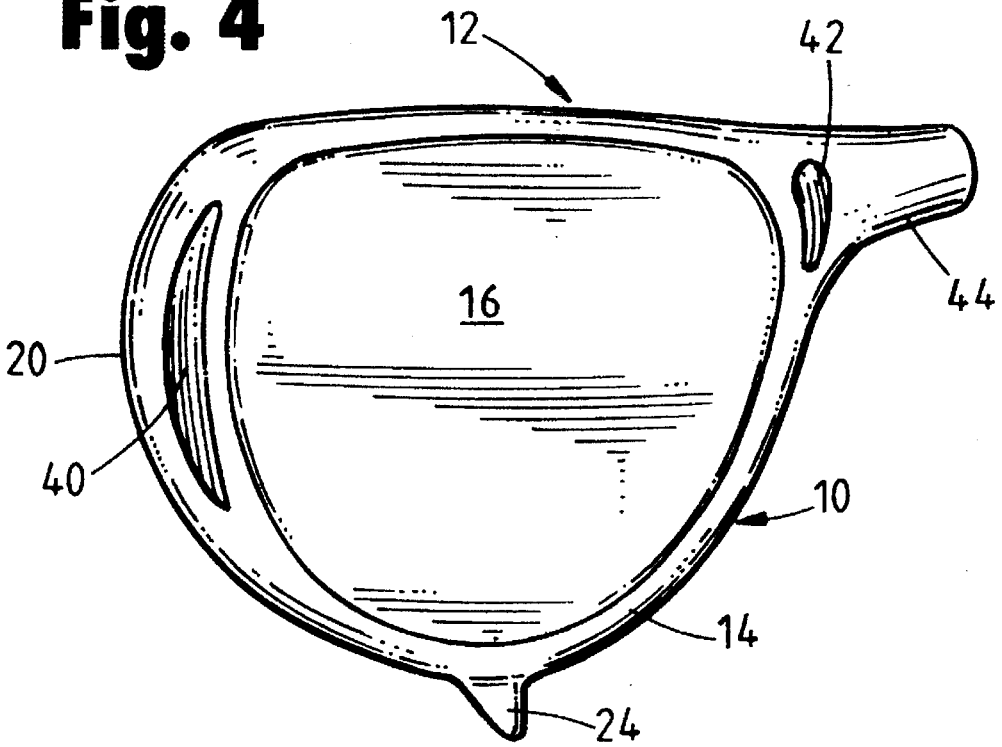
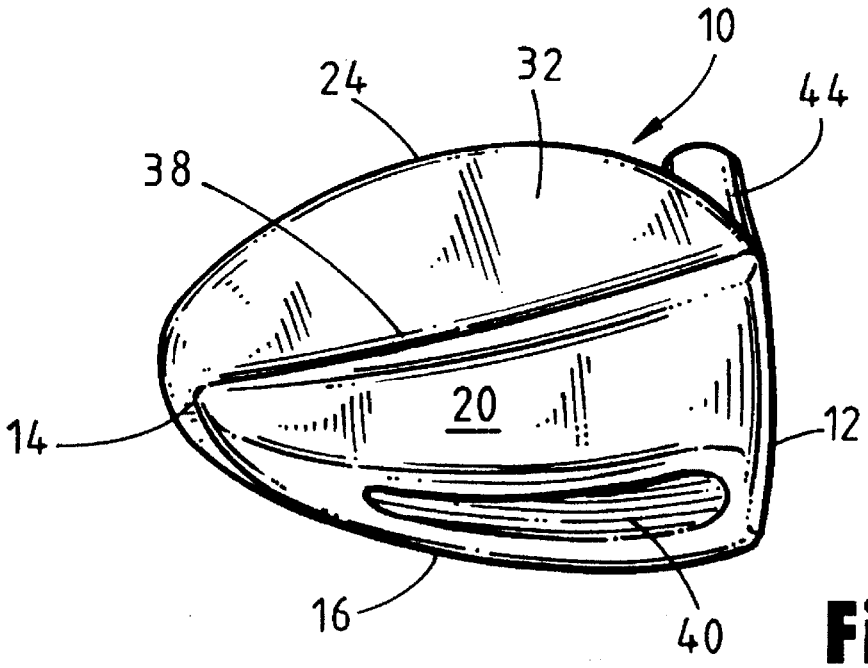
Fig. 5

GOLF CLUBHEAD

TECHNICAL FIELD

This invention relates generally to a clubhead for a golf club and more particularly to a golf clubhead having a plurality of aerodynamic control and guide surfaces disposed on the exterior of the clubhead.

BACKGROUND ART

Many improvements have been made in an attempt, notwithstanding a player's skill level, to improve a golfer's performance. In particular, much attention has been directed towards the golf club used to hit a golf ball. For example, different shapes of the clubhead have been proposed to decrease aerodynamic drag, different materials have been proposed to increase ball flight distance and feel of the club, and various weighting schemes, including perimeter weighting, have been proposed to optimize the center of gravity and moment of inertia of the clubhead.

However, heretofore, none of the clubheads known to the inventor provide any aerodynamic control surfaces which, during swinging of the clubhead through an arcuate path toward the ball, produce local aerodynamic forces that act to urge the clubhead into an optimum orientation with respect to the direction in which the clubhead is moving. That is, there are no surfaces on any presently known clubhead which tend to urge the clubhead, during the forward swing stroke, into a predetermined desired alignment with a golf ball at the point of impact with the ball.

Furthermore, some golf clubheads have placed aerodynamic resistance, or drag, reducing surfaces on a particular surface, such as the crown or rear surface, of a clubhead. These modifications have arguably resulted in some reduction in aerodynamic drag and, accordingly, a potential increase in clubhead velocity.

The present invention is directed to overcoming the problems set forth above. It is desirable to have a clubhead with a vane that is exposed to the flow of air past the clubhead and is so arranged as to urge the clubhead into a desired orientation with respect to the direction of motion of the clubhead. It is also desirable to have a golf clubhead in which air resistance-reducing surfaces are provided on plural surfaces of portions of the clubhead.

SUMMARY OF THE INVENTION

In accordance with one aspect of the present invention, a golf clubhead having face, rear, sole, crown, toe and heel portions has aerodynamic control surfaces on the crown, toe and heel portions of the clubhead which act to reduce the aerodynamic resistance to movement of the clubhead through air.

Other features of the clubhead embodying the present invention include the crown portion of the clubhead having a predefined surface contour that is concave in an area adjacent the heel portion, and is compound curved in both concave and convex directions in an area adjacent the toe portion of the clubhead.

In another aspect of the present invention a golf clubhead has a vane extending outwardly from the surface of the crown and rear portions. The vane is positioned substantially midway between the heel and sole portions of the clubhead and extends continuously from the face portion to the sole portion along a line that is substantially perpendicular to the face surface.

Other features of the clubhead embodying the present invention include the outwardly extending vane having an airfoil shape that is contoured to exert a centrifugal force normal to an arcuate direction of motion of the clubhead.

Still other objects, features and advantages of the present invention will be apparent from the following description of the preferred embodiments given for the purpose of disclosure and taken in conjunction with the accompanying drawings.

BRIEF DESCRIPTION OF THE DRAWINGS

FIG. 4 is a bottom view of the golf clubhead embodying the present invention;

FIG. 5 is a side view looking toward the toe of the golf clubhead embodying the present invention;

DESCRIPTION OF THE PREFERRED EMBODIMENT

Figure 1:
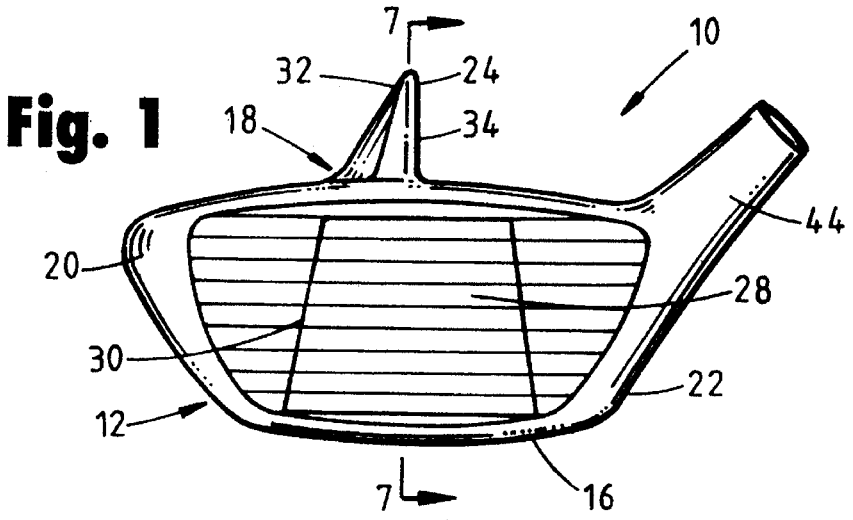
FIG. 1 is a face view of the golf clubhead embodying the present invention.
Figure 2:
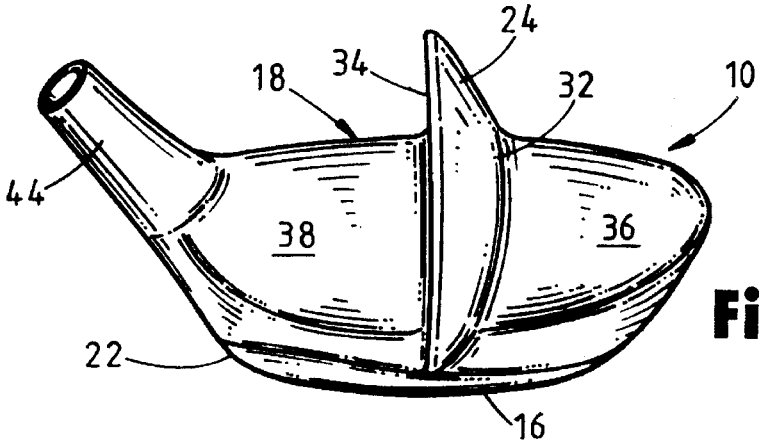
FIG. 2 is a rear view of the golf clubhead embodying the present invention.

A golf clubhead 10 embodying the present invention includes a face portion 12, a rear portion 14, a sole portion 16, a crown portion 18, a toe portion 20, and a heel portion 22. These portions are all conventional elements typically found in most drivers, but the surfaces of several of these portions, in the present invention, have important aerodynamic contours or shapes that lessen the resistance to passage of the clubhead 10 through the air when swung to hit a golf ball.

Figure 6:
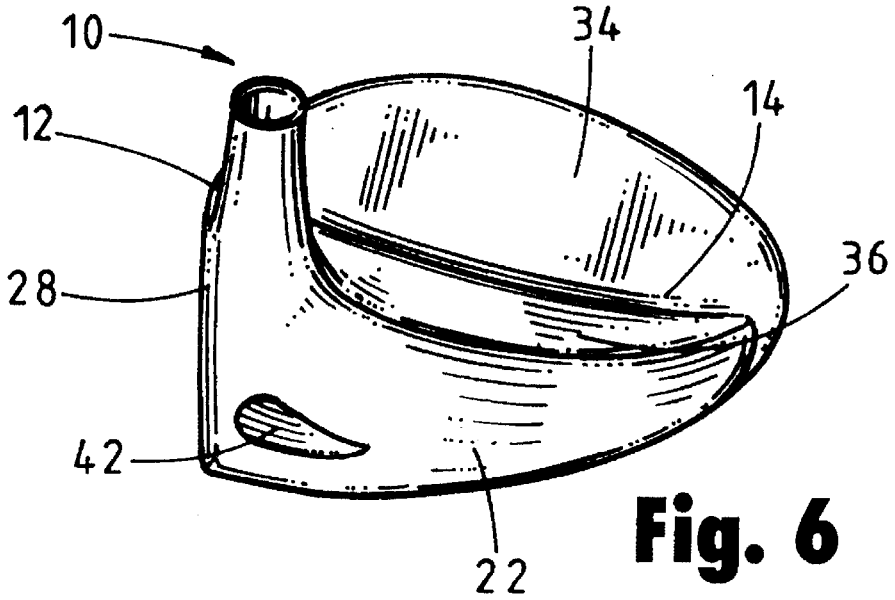
FIG. 6 is a side view looking toward the heel of the golf clubhead embodying the present invention; and, FIG. 7 is a sectional view of the golf clubhead embodying the present invention, taken along the line 7—7 of FIG. 1.
Figure 7:
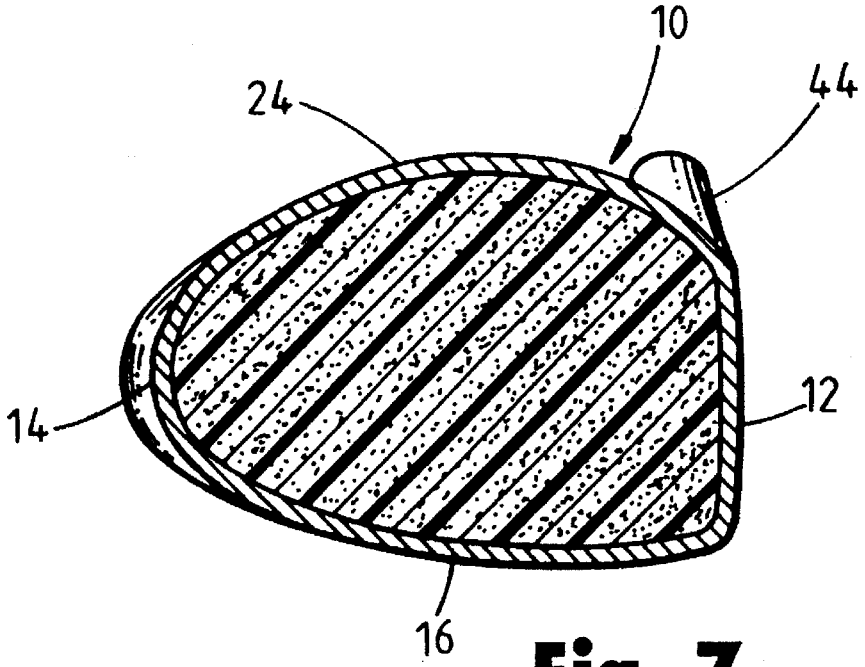

In the preferred embodiment of the present invention, the golf clubhead 10 also has a fin, or vane, 24 that extends outwardly from the surface of the crown portion 18 and the rear portion 14, preferably on a centerline intersecting the center of gravity of the clubhead 10. As best shown in FIG. 1, the vane 24 is positioned about midway between the heel 22 and toe 20. Also, as can be seen in FIGS. 5 and 6, the vane 24 extends continuously over the crown and rear portions 18,14 beginning at the face 12 and terminating at the sole 16.

Figure 3:
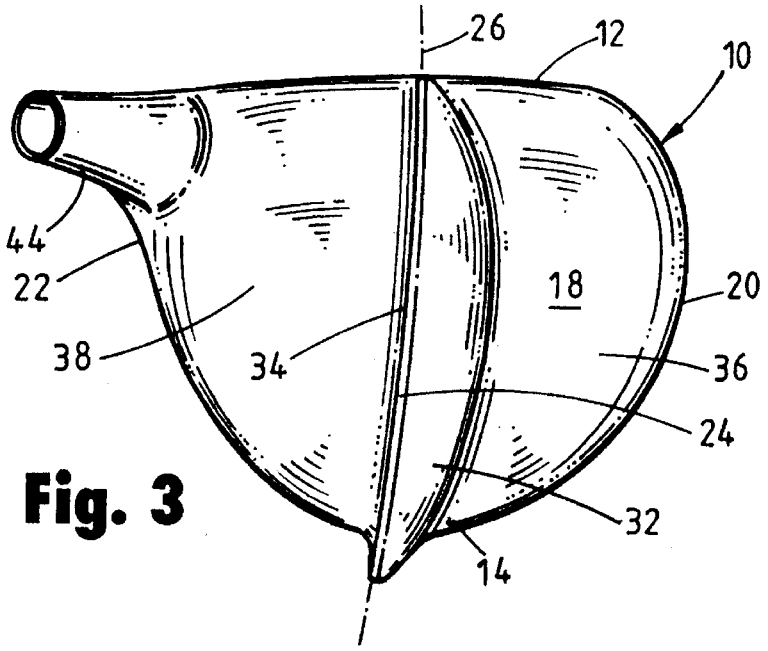
FIG. 3 is a top view of the golf clubhead embodying the present invention.

The vane 24 has a longitudinal axis 26 that, in the preferred embodiment of the present invention, is substantially perpendicular to a face surface 28 on the face portion 12 of the clubhead 10. More specifically, the face surface 28 typically is slightly curved to form a characteristic outward bulge, and the longitudinal axis 26 of the vane 24 is desirably normal to the curved surface at the forward, or face, end of the vane 24. As best shown in FIG. 3, the forward portion of the longitudinal axis 26, and accordingly the vane 24, extends rearwardly along an essentially straight, linear path from the face 12. As the longitudinal axis 26 nears the rear portion 12, the axis 26 defined by the vane 24 desirably curves slightly toward the heel 22 of the clubhead.

Furthermore, it is desirable that the vane 24 be inclined somewhat toward the heel portion 42 as shown in FIG. 1. The angle of inclination is desirably from about 0° to about 15° from a vertical line perpendicular to the parallel, horizontal lines 30 customarily scribed on the face surface 28.

The lines 30 are intended to be positioned substantially parallel to the ground when the club is held at the desired address position prior to initiating a backswing. If the ensuing stroke is properly executed, the scribed lines 30 will be substantially parallel to the ground at the moment of impact of the clubhead 10 with the ball.

Additionally, it is desirable that the contoured surfaces of the vane 24 form a closed curve defining an external shape having the cross section of an airfoil. Preferably, an outer, i.e., the vane side facing the toe 20, curved surface 32 has a convex surface, and the opposite side of the vane 24 facing the heel has a flat or slightly concave curved surface 34. This shape of the vane 24, which is not unlike that of the cross section of an airplane wing, forms a shape that produces a force, as a result of the vane 24 passing through the air, that has a component acting on the vane 24 that is normal to the direction of motion. That is, the airfoil profile of the vane 24 causes the air passing over the vane 24 to exert a centrifugal force normal to an arcuate direction of motion in response to swinging the clubhead 10 through the arcuate path.

Importantly, the centrifugal force imposed on the vane 24 tends to urge the clubhead 10 into a wider swing thereby producing higher clubhead velocity. Higher clubhead velocity at point of impact with the ball results in longer drives. Furthermore, the vane 24, either with or without an airfoil profile tends to align the clubhead 10 with the direction of motion so that the face surface 28 is square with the ball at the point of impact. This feature of the clubhead 10 embodying the present invention helps to eliminate an oblique alignment of the clubhead 10, resulting in more stability in the clubhead 10. These characteristics yield a clubhead 10 that has a larger "sweet spot" and is more forgiving of off-center contact with the ball.

Also, several of the outer surfaces of the clubhead 10 have specifically shaped aerodynamic contours to reduce drag, or wind resistance, as the clubhead moves through the air. These surfaces combine to further stabilize the clubhead 10 and contribute to higher clubhead velocity at impact with a ball. As shown in the drawings, the surface of the crown portion 18 is curved inwardly between the vane 24 and the heel portion 22 to form a concave surface 36, and shaped to form a compound curved surface 38 between the vane 24 and the toe portion 20. More specifically, the crown surface 38 on the toe side of the vane 24 is inwardly curved to form a concave contour adjacent the face portion 12, a convex contour area about midway between the face surface 28 and the rear portion 14, and inwardly curved in another concave contour adjacent the rear portion 14. The underside of the toe portion 20 has a concave surface extending from a position adjacent the face portion 12 to a position adjacent the rear portion 14 and is tapered to form a channel 40 that converges toward the rear portion 14. Another convergent tapered concave channel 22 is formed in the surface of the heel portion 22 between the crown portion 18 and the heel portion 16. As mentioned above, all of the above contoured surfaces cooperate to decrease wind resistance whereby the clubhead velocity is increased and the clubhead stabilized as it passes through the impact zone. The sole portion 16 is also cambered to reduce the tendency of the club to fly, and pulls the clubhead 10 close to the ground as it approaches the ball.

The hosel 44 of the clubhead 10 is positioned to align the hosel 44 with the center of gravity of clubhead 10. In the preferred embodiment of the present invention, the size of the rear portion 14 is somewhat reduced to provide more aerodynamic reaction surface for the vane 24. The hosel placement compensates for the reduced mass of the rear portion 24. Also, it should be noted that the rear portion of the vane 24 extends beyond and below the rear portion 24 thus inherently giving the clubhead 10 a lower and deeper, i.e., towards the sole 16 and rear 14, center of gravity.

The clubhead 10 may be constructed of metal, wood, graphite, composite or other material. Preferably the: clubhead 10 is formed of stainless steel by investment casting. Typically, the clubheads of the lower numbered drivers, conventionally referred to as "woods" whether they be made of wood, metal or other material, and irrespective of whether they be standard, midsized, oversized or jumbo, are perimeter weighted. This is rather easily accomplished by casting metal, e.g. by investment casting, by compression molding around a temporary cavity-forming core, or machining away unwanted material and affixing a removable plate such as a sole plate, faceplate or insert over the cavity. The cavity in the clubhead 10 is then typically filled with a lightweight synthetic foam material such as polyurethane, or cork, or viscous jell as is well known by those skilled in the art. Thus the weight of the clubhead 10 is primarily distributed on the perimeter, that is, on the face 12, surrounding walls, crown 18 and sole 16 walls. Perimeter weighting results in a greater moment of inertia for the clubhead 10 which means that it is more resistant to twisting at impact if the ball is struck somewhere other than on the centerline of the clubface. This characteristic is also associated with an enlarged "sweet spot" because a ball hit towards the toe 20 or heel 22 will go straighter and, because there is more mass at these points, will probably go farther. The thickness of the walls can also be varied to adjust the weight so that it can be placed in a desired area of the perimeter to controllably position the center of gravity, or center of mass, of the clubhead 10.

The face angle, or loft angle, of the clubhead face surface 28 is typically from about to 9° to about 11° for a 1-wood. Other drivers vary according to how much rise, or loft, is desired in the driven ball. Preferably the loft angle of the clubhead 10 embodying the present invention is about 9.75°.

INDUSTRIAL APPLICABILITY

The golf clubhead 10 embodying the present invention is particularly useful for correcting misalignment between the face surface 28 and the ball at impact. The vane 24 tends to align the clubhead 10 with the direction of motion so that the face surface 28 is square with the ball at the point of impact. Thus, the present invention helps to eliminate oblique alignment of the clubhead 10 which, when combined with the aerodynamic surface contours and perimeter weighting, produces a clubhead 10 that has a larger "sweet spot" and is more forgiving of off-center contact with the ball.

Furthermore, the combination of the aerodynamic surface contours 36,38,40,and 42, and the wind forces acting on the vane 24, provide a combination of forces when the club is in its proper swing path, that reduces aerodynamic drag and allows the clubhead 10 to reach its maximum velocity in the impact zone.

Thus, the clubhead 10 embodying the present invention has an inherent tendency to align itself with respect to the swing path, and produce a wider, faster swing path. In this sense, the clubhead 10 is self correcting. If the clubhead 10 is moving at the optimum swing speed, in its widest arc, and is aligned with the swing path, the vane 24 will have less effect on the swing stroke dynamics. Advantageously, the influence of the vane 24 and the aerodynamic surfaces of the clubhead 10 increases with the need for corrective alignment.

Nothwithstanding that the invention is described in terms of particular preferred embodiments, it will be understood that the present invention is not to be construed as limited to such, but rather to the lawful scope of the appended claims. Other aspects, features and advantages of the present invention can be obtained from a study of this disclosure together with the appended claims.

What is claimed is:

1. A golf clubhead having face, rear, sole, crown, toe and heel portions, each of said portions having a predefined surface contour, and said portions cooperating to produce an aerodynamic control surface which reduces the aerodynamic resistance to movement of the clubhead through air, wherein the predefined surface contour of said crown portion includes a concave surface adjacent said heel portion and a compound curved section having a concave contoured area and a convex contoured area adjacent said toe portion; and the predefined surface contour of said toe portion includes a concave surface disposed, between said crown portion and said sole portion and extending from a forward position adjacent said face portion to a position adjacent said rear portion, said concave surface forming a generally convergent tapered channel in a direction from said face portion to said rear portion.

2. The golf clubhead, as set forth in claim 1, wherein the surface contour of said heel portion includes a concave surface formed on a portion of said contoured heel portion disposed between said crown portion and said sole portion.

3. A golf clubhead having face, rear, sole, crown, toe and heel portions, each of said portions having a predefined surface area, the improvement comprising:

a face portion having a curved surface forming a convex bulge between a heel portion and a toe portion;

a vane extending outwardly from the surface of a crown portion and a rear portion at a position substantially midway between said heel and said toe portions and extending continuously from said face portion to a sole portion along a longitudinal axis having a linear segment adjacent said face portion that is substantially normal to the curved surface of said face.

4. The golf clubhead, as set forth in claim 3, wherein the longitudinal axis of said vane has a nonlinear section adjacent said rear portion that is curved in a direction towards said heel portion.

5. The golf clubhead, as set forth in claim 3, wherein said face surface has a plurality of parallel lines disposed in a generally horizontal direction when said clubhead is at the desired point of impact with a golf ball, and said vane is inclined at an angle of from about 0° to about 15° from a line perpendicular to said horizontally disposed parallel lines.

6. The golf clubhead, as set forth in claim 3, wherein said crown portion includes a concave surface disposed between said vane and said heel portions.

7. The golf clubhead, as set forth in claim 3, wherein said crown portion includes a compound curved surface comprising a concave contoured area and a convex contoured area disposed between said vane and said toe portion.

8. The golf clubhead, as set forth in claim 3, wherein said toe portion has a concave surface disposed between said crown portion and said sole portion and extending from face portion to said rear portion.

9. The golf clubhead, as set forth in claim 3, wherein said heel portion has a concave surface disposed between said crown portion and said sole portion.

10. The golf clubhead, as set forth in claim 3, wherein said vane is an airfoil shape, which exerts a centrifugal force normal to an arcuate direction of motion of said clubhead swinging through an arcuate path.

11. The golf clubhead, as set forth in claim 3, wherein the predefined surfaces of said sole, crown, rear, toe, and heel portions intersect to produce an aerodynamic contour, whereby the aerodynamic drag imposed on said clubhead when passing through an arcuate path is less than that of a similarly sized clubhead without said intersecting contoured surfaces.

12. A golf clubhead, as set forth in claim 3, wherein said clubhead is formed of a metal material having a hollow center that is filled with a material having a specific gravity less than that of said metal material.

13. A golf clubhead, comprising:

a heel portion having a hosel adapted to receive a shaft;

a toe portion spaced from said heel portion;

a face portion extending between said heel portion and said toe portion, having a curved surface forming a convex bulge between said heel and said toe portions;

a sole portion extending between said heel portion and said toe portion;

a crown portion spaced from said sole portion and extending between said heel portion and said toe portion and having a predefined surface;

a rear portion spaced from said face portion and extending between said heel, toe, crown, and sole portions and having a predefined surface; and a vane extending outwardly from the surface of said crown portion and the surface of said rear portion from said face portion to said sole portion along a line substantially perpendicular to said face portion, wherein the longitudinal axis of said vane has a linear segment adjacent said face portion that is substantially normal to the curved surface of said face portion.

14. The golf clubhead, as set forth in claim 13, wherein the longitudinal axis of said vane has a nonlinear section adjacent said rear portion that is curved in a direction towards said heel portion.

15. The golf clubhead, as set forth in claim 12, wherein said clubface has an axis extending from said heel portion to said toe portion that is substantially parallel to a ground surface when said clubhead is at a desired point of impact with a golf ball, said vane being inclined toward said heel portion at an angle of from about 0° to about 15° from a line perpendicular to said horizontally axis.

16. The golf clubhead, as set forth in claim 13, wherein said vane is disposed at a position substantially midway between said heel portion and said toe portion.

17. The golf clubhead, as set forth in claim 13, wherein said crown portion includes a concave surface disposed between said vane and said heel portions.

18. The golf clubhead, as set forth in claim 13, wherein said crown portion includes a compound curved surface comprising a concave contoured area and a convex contoured area disposed between said vane and said toe portion.

19. The golf clubhead, as set forth in claim 13, wherein said toe portion has a concave surface disposed between said crown portion and said sole portion and extending from face portion to said rear portion, said concave surface on said nose portion forming a generally tapered channel converging in a direction towards said rear portion.

20. The golf clubhead, as set forth in claim 13, wherein said heel portion has a concave surface disposed between the hosel on said heel portion and said sole portion.

21. The golf clubhead, as set forth in claim 13, wherein said vane is an airfoil shape, which exerts a centrifugal force normal to an arcuate direction of motion of said clubhead swinging through an arcuate path.

22. The golf clubhead, as set forth in claim 13, wherein the predefined surfaces of said sole, crown, rear, toe, and heel portions intersect to produce an aerodynamic contour, whereby the aerodynamic drag imposed on said clubhead when passing through an arcuate path is less than that of a similarly sized clubhead without said intersecting contoured surfaces.

* * * * *